US010819025B2

(12) United States Patent
Hsiao et al.

(10) Patent No.: US 10,819,025 B2
(45) Date of Patent: Oct. 27, 2020

(54) ANTENNA STRUCTURE

(71) Applicant: Wistron NeWeb Corp., Hsinchu (TW)

(72) Inventors: An-Ting Hsiao, Hsinchu (TW); Shang-Sian You, Hsinchu (TW)

(73) Assignee: WISTRON NEWEB CORP., Hsinchu (TW)

( * ) Notice: Subject to any disclaimer, the term of this patent is extended or adjusted under 35 U.S.C. 154(b) by 61 days.

(21) Appl. No.: 16/278,334

(22) Filed: Feb. 18, 2019

(65) Prior Publication Data

US 2019/0372208 A1 Dec. 5, 2019

(30) Foreign Application Priority Data

Jun. 4, 2018 (TW) ..... 107119160 A

(51) Int. Cl.
*H01Q 1/36* (2006.01)

(52) U.S. Cl.
CPC ..... *H01Q 1/364* (2013.01)

(58) Field of Classification Search
CPC ..... H01Q 1/346; H01Q 9/42; H01Q 5/35
See application file for complete search history.

(56) References Cited

U.S. PATENT DOCUMENTS

2002/0044099 A1* 4/2002 Yamamoto ..... H01Q 13/18 343/789
2005/0116867 A1* 6/2005 Park ..... H01Q 9/0457 343/725
2006/0125713 A1* 6/2006 Thevenot ..... H01Q 5/28 343/909
2012/0169562 A1* 7/2012 Nysen ..... H01Q 9/40 343/843
2012/0299798 A1* 11/2012 Leisten ..... H01Q 5/35 343/895
2014/0062824 A1* 3/2014 Yamaguchi ..... H01Q 21/0006 343/835

(Continued)

FOREIGN PATENT DOCUMENTS

CN 106941208 A 7/2017
CN 106972242 A 7/2017

(Continued)

OTHER PUBLICATIONS

Li, Q. et al.; "Planar Quasi-Isotropic Magnetic Dipole Antenna Using Fractional-Order Circular Sector Cavity Resonant Mode;" IEEE Access; vol. 5; Apr. 2017; pp. 8515-8525.

*Primary Examiner* — Raymond R Chai
(74) *Attorney, Agent, or Firm* — McClure, Qualey & Rodack, LLP

(57) ABSTRACT

An antenna structure includes a first conductive layer, a second conductive layer, a bent conductive layer, and a first coaxial cable. The second conductive layer has a first opening. A cavity is formed between the first conductive layer and the second conductive layer. The bent conductive layer is coupled between the first conductive layer and the second conductive layer. The bent conductive layer is configured to divide the cavity into a first portion and a second portion. The first coaxial cable includes a first central conductive line and a first conductive shielding. The first central conductive line extending through the first opening is coupled to a first feeding point on the first conductive layer. The first conductive shielding is coupled to the second conductive layer.

19 Claims, 9 Drawing Sheets

(56) References Cited

U.S. PATENT DOCUMENTS

| | | | | |
|---|---|---|---|---|
| 2017/0110790 | A1* | 4/2017 | Kim | H01Q 21/0062 |
| 2018/0183148 | A1 | 6/2018 | Pan et al. | |
| 2018/0323490 | A1* | 11/2018 | Harp | H01Q 1/38 |

FOREIGN PATENT DOCUMENTS

| | | | |
|---|---|---|---|
| CN | 107069215 | A | 8/2017 |
| CN | 107331949 | A | 11/2017 |
| TW | 568379 | | 12/2003 |
| TW | 200805783 | A | 1/2008 |

* cited by examiner

ANTENNA STRUCTURE

CROSS REFERENCE TO RELATED APPLICATIONS

This application claims priority of Taiwan Patent Application No. 107119160 filed on Jun. 4, 2018, the entirety of which is incorporated by reference herein.

BACKGROUND OF THE INVENTION

Field of the Invention

The disclosure generally relates to an antenna structure, and more particularly, it relates to a wideband antenna structure with high radiation efficiency.

Description of the Related Art

With the advancements being made in mobile communication technology, mobile devices such as portable computers, mobile phones, multimedia players, and other hybrid functional portable electronic devices have become more common. To satisfy user demand, mobile devices can usually perform wireless communication functions. Some devices cover a large wireless communication area; these include mobile phones using 2G, 3G, and LTE (Long Term Evolution) systems and using frequency bands of 700 MHz, 850 MHz, 900 MHz, 1800 MHz, 1900 MHz, 2100 MHz, 2300 MHz, 2500 MHz, and 2700 MHz. Some devices cover a small wireless communication area; these include mobile phones using Wi-Fi and Bluetooth systems and using frequency bands of 2.4 GHz, 5.2 GHz, and 5.8 GHz.

For example, wireless access points are indispensable elements that allow mobile devices in a room to connect to the Internet at high speeds. However, since indoor environments have serious problems with signal reflection and multipath fading, wireless access points should process signals in a variety of polarization directions and from a variety of transmission directions simultaneously. Accordingly, it has become a critical challenge for antenna designers to design a wideband, omnidirectional antenna in the limited space of a wireless access point.

BRIEF SUMMARY OF THE INVENTION

In an exemplary embodiment, the disclosure is directed to an antenna structure including a first conductive layer, a second conductive layer, a bent conductive layer, and a first coaxial cable. The second conductive layer has a first opening. A cavity is formed between the first conductive layer and the second conductive layer. The bent conductive layer is coupled between the first conductive layer and the second conductive layer. The bent conductive layer is configured to divide the cavity into a first portion and a second portion. The first coaxial cable includes a first central conductive line and a first conductive shielding. The first central conductive line extending through the first opening is coupled to a first feeding point on the first conductive layer. The first conductive shielding is coupled to the second conductive layer.

BRIEF DESCRIPTION OF DRAWINGS

The invention can be more fully understood by reading the subsequent detailed description and examples with references made to the accompanying drawings, wherein.

DETAILED DESCRIPTION OF THE INVENTION

In order to illustrate the purposes, features and advantages of the invention, the embodiments and figures of the invention are shown in detail as follows.

Certain terms are used throughout the description and following claims to refer to particular components. As one skilled in the art will appreciate, manufacturers may refer to a component by different names. This document does not intend to distinguish between components that differ in name but not function. In the following description and in the claims, the terms "include" and "comprise" are used in an open-ended fashion, and thus should be interpreted to mean "include, but not limited to . . . ". The term "substantially" means the value is within an acceptable error range. One skilled in the art can solve the technical problem within a predetermined error range and achieve the proposed technical performance. Also, the term "couple" is intended to mean either an indirect or direct electrical connection. Accordingly, if one device is coupled to another device, that connection may be through a direct electrical connection, or through an indirect electrical connection via other devices and connections.

Figure 1A:
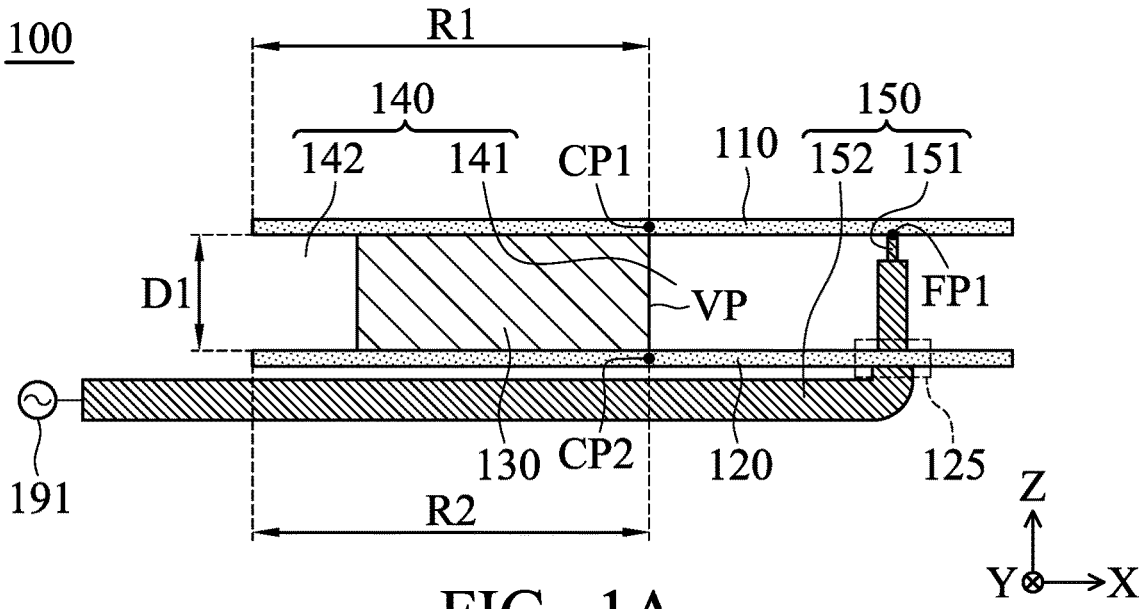
FIG. 1A is a side view of an antenna structure according to an embodiment of the invention.
Figure 1B:
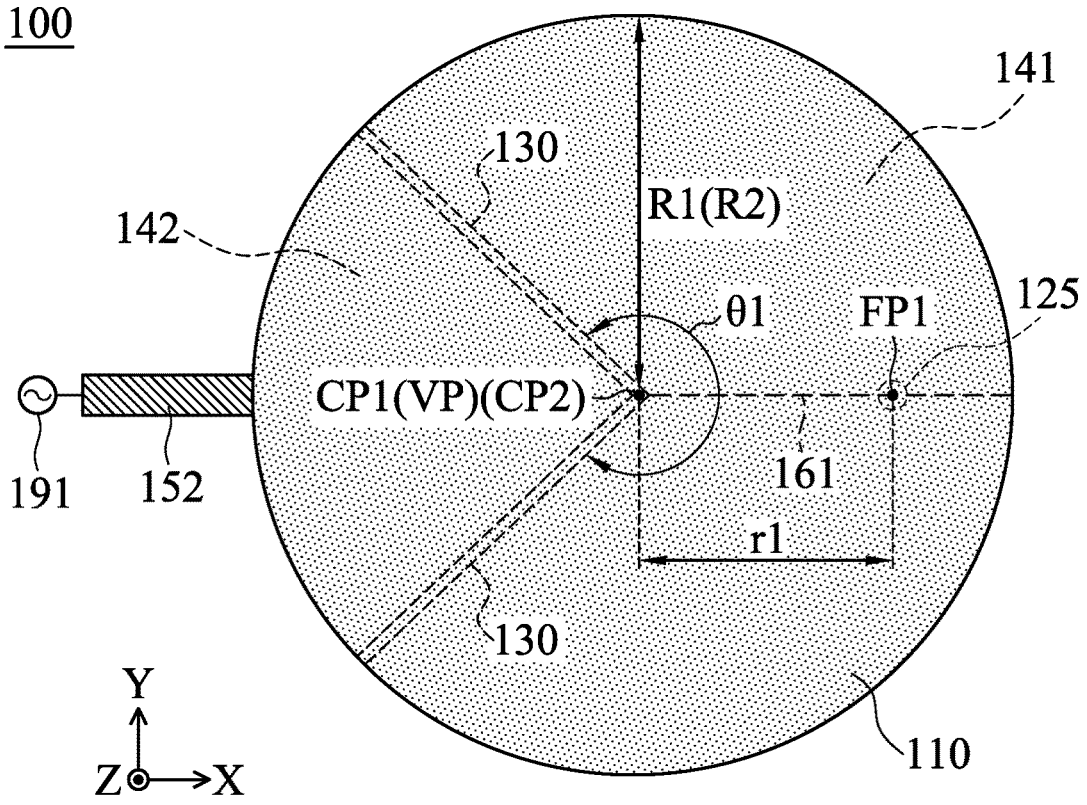
FIG. 1B is a top view of an antenna structure according to an embodiment of the invention.

FIG. 1A is a side view of an antenna structure 100 according to an embodiment of the invention. FIG. 1B is a top view of the antenna structure 100 according to an embodiment of the invention. Please refer to FIG. 1A and FIG. 1B together. The antenna structure 100 may be applied in a wireless access point. In the embodiment of FIG. 1A and FIG. 1B, the antenna structure 100 includes a first conductive layer 110, a second conductive layer 120, a bent conductive layer 130, and a first coaxial cable 150. The above elements of the antenna structure 100 may be made of metal materials, such as copper, silver, aluminum, iron, or their alloys. In some embodiments, each conductive layer is implemented with a thin metal piece.

The first conductive layer 110 and the second conductive layer 120 may be separate from each other and may be substantially parallel to each other. For example, the first conductive layer 110 may substantially have a first circular shape, and the second conductive layer 120 may substantially have a second circular shape. The first circular shape and the second circular shape may have the same or different sizes. The second conductive layer 120 has a first opening 125, which may have any shape and any size. For example, the first opening 125 may substantially have a circular shape, a triangular shape, or a quadrilateral shape, but it is not limited thereto. A cavity 140 is formed between the first conductive layer 110 and the second conductive layer 120, and it is used as a resonant cavity of the antenna structure 100.

The bent conductive layer 130 is directly coupled between the first conductive layer 110 and the second conductive layer 120. The bent conductive layer 130 is configured to divide the cavity 140 into a first portion 141 and a second portion 142, such that the first portion 141 and the second portion 142 of the cavity 140 is positioned at two different sides of the bent conductive layer 130, respectively. In some embodiments, the central point CP1 of the first conductive layer 110 (i.e., the center of the first circular shape), the central point CP2 of the second conductive layer 120 (i.e., the center of the second circular shape), and the bending line VP of the bent conductive layer 130 (i.e., at its transition) are arranged in the same straight line. The aforementioned straight line is considered as a central axis of symmetry relative to the antenna structure 100. Furthermore, the bent conductive layer 130 extends to the edge of the first conductive layer 110 (i.e., the circumference of the first circular shape) and the edge of the second conductive layer 120 (i.e., the circumference of the second circular shape), so as to completely separate the first portion 141 and the second portion 142 of the cavity 140.

The first coaxial cable 150 includes a first central conductive line 151 and a first conductive shielding 152. The first central conductive line 151 extends through the first opening 125, and the first central conductive line 151 is coupled to a first feeding point FP1 on the first conductive layer 110. The first conductive shielding 152 is coupled to the second conductive layer 120. A first signal source 191 is arranged for exciting the antenna structure 100. For example, the first signal source 191 may be an RF (Radio Frequency) module. The positive electrode of the first signal source 191 may be coupled to the first central conductive line 151, and the negative electrode of the first signal source 191 may be coupled to the first conductive shielding 152. In some embodiments, the bent conductive layer 130 has a first angle θ1 relative to its bending line VP, and the first feeding point FP1 is substantially positioned on the bisector plane 161 of the first angle θ1. In some embodiments, the first coaxial cable 150 is adjacent to and at least partially parallel to the second conductive layer 120 (or the first coaxial cable 150 has at least one right-angle bending portion). It should be noted that the term "adjacent" or "close" over the disclosure means that the distance (spacing) between two corresponding elements is smaller than a predetermined distance (e.g., 5 mm or the shorter), or means that the two corresponding elements directly touch each other (i.e., the aforementioned distance/spacing therebetween is reduced to 0).

Figure 2:
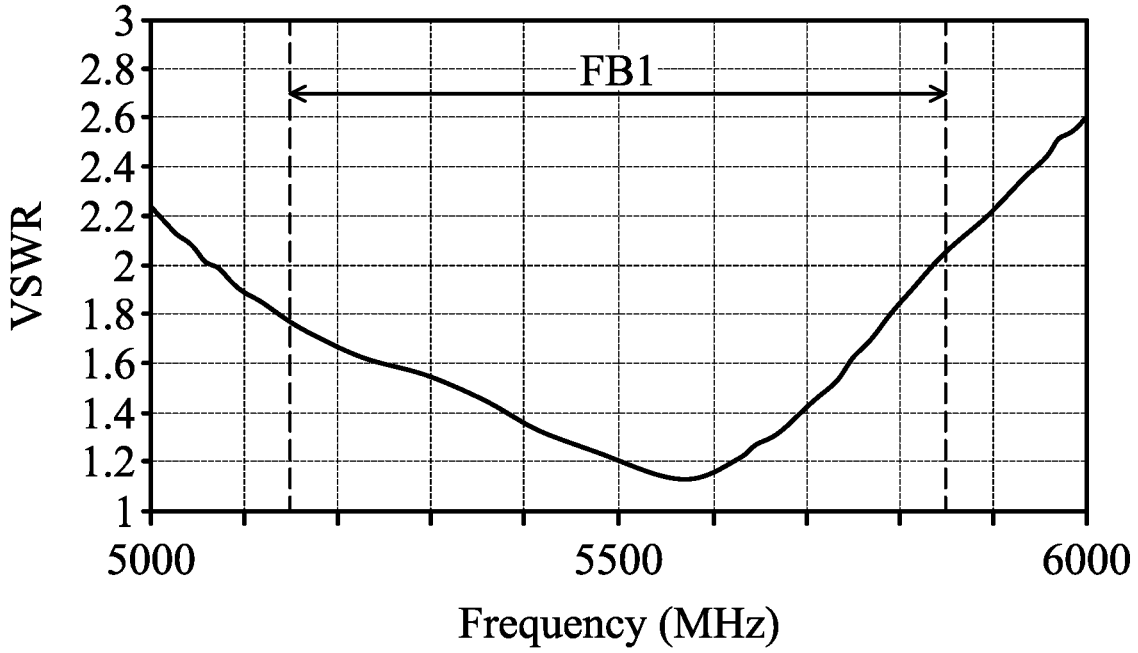
FIG. 2 is a diagram of VSWR (Voltage Standing Wave Ratio) of an antenna structure according to an embodiment of the invention.

FIG. 2 is a diagram of VSWR (Voltage Standing Wave Ratio) of the antenna structure 100 according to an embodiment of the invention. According to the measurement of FIG. 2, the antenna structure 100 can cover an operation frequency band FB1 from 5150 MHz to 5850 MHz, and the relative bandwidth of the operation frequency band FB1 is about 13.95%. It should be noted that the relative bandwidth of a conventional cavity antenna is usually only from 2.5% to 5%. Therefore, the proposed antenna structure 100 can improve the relative bandwidth by about 179%, and it can support at least the wideband operations of WLAN (Wireless Local Area Network).

Figure 3:
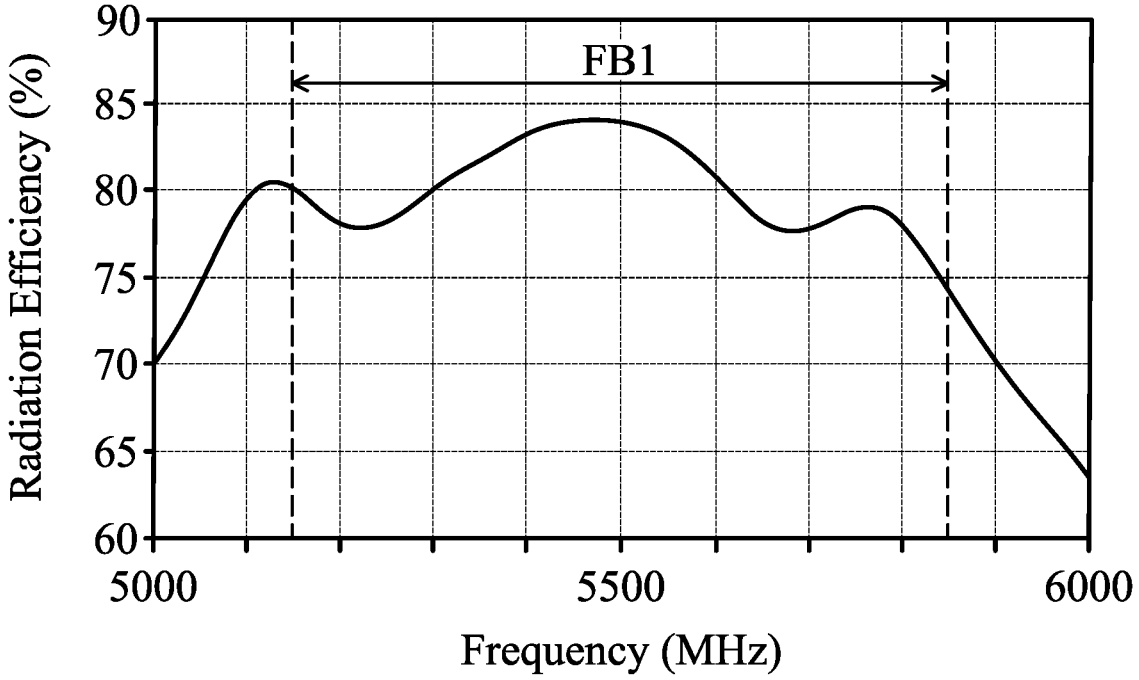
FIG. 3 is a diagram of radiation efficiency of an antenna structure according to an embodiment of the invention.

FIG. 3 is a diagram of radiation efficiency of the antenna structure 100 according to an embodiment of the invention. According to the measurement of FIG. 3, the radiation efficiency of the antenna structure 100 is at least 75% within the aforementioned operation frequency band FB1, and the radiation efficiency of the antenna structure 100 reaches about 84.9% at the central frequency of the aforementioned operation frequency band FB1. This can meet the requirement of practical applications of general mobile communication devices.

Figure 4A:
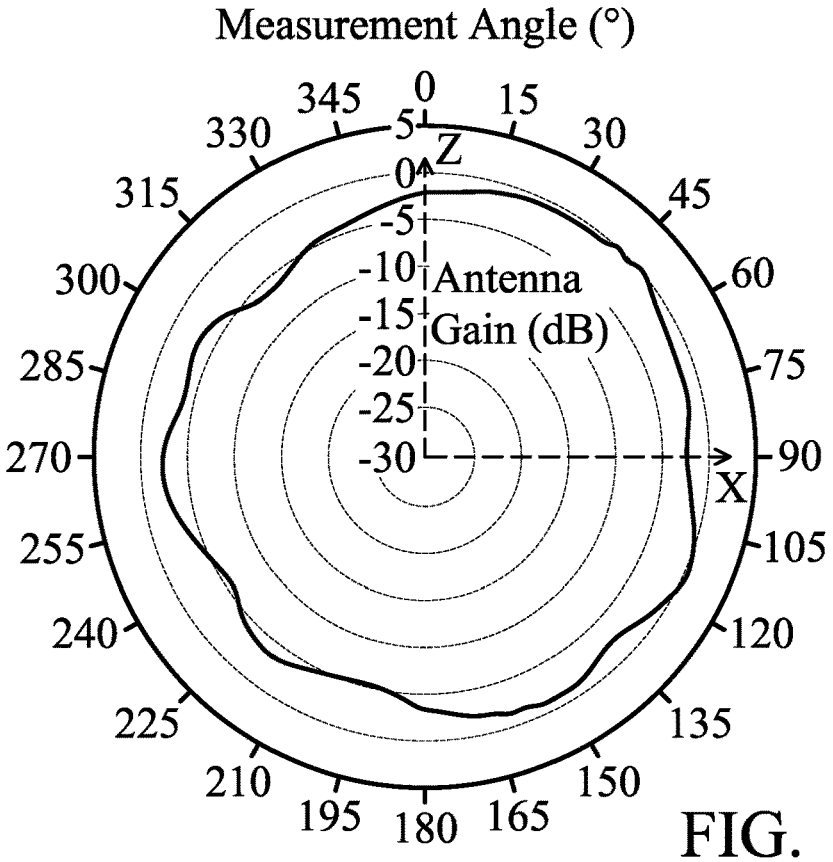
FIG. 4A is a diagram of antenna gain of an antenna structure measured on a plane according to an embodiment of the invention.
Figure 4B:
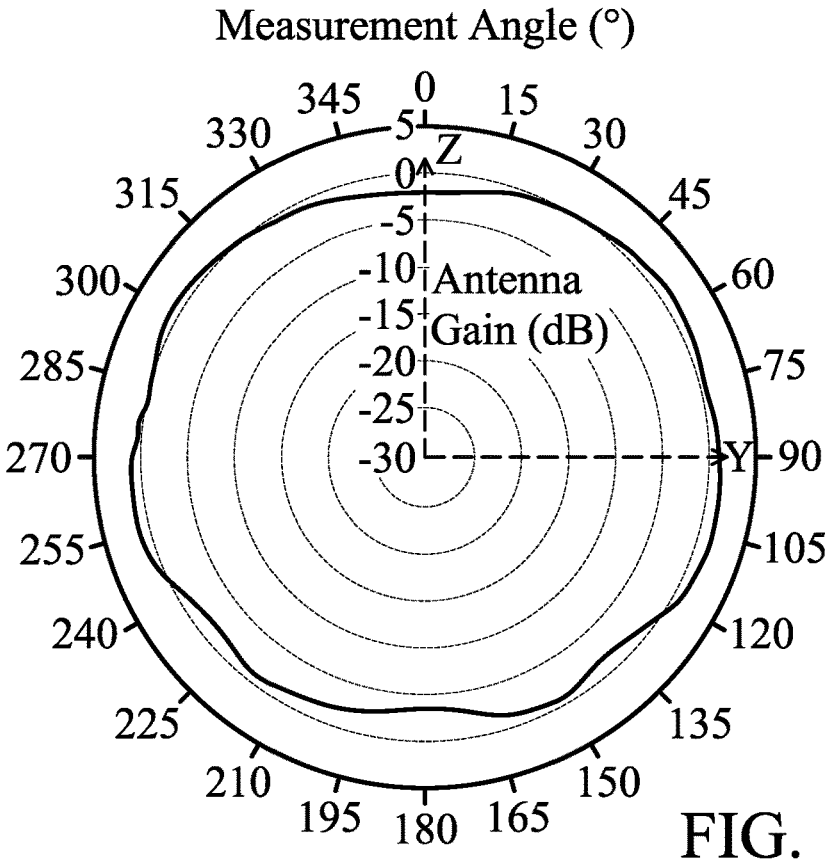
FIG. 4B is a diagram of antenna gain of an antenna structure measured on another plane according to an embodiment of the invention.
Figure 4C:
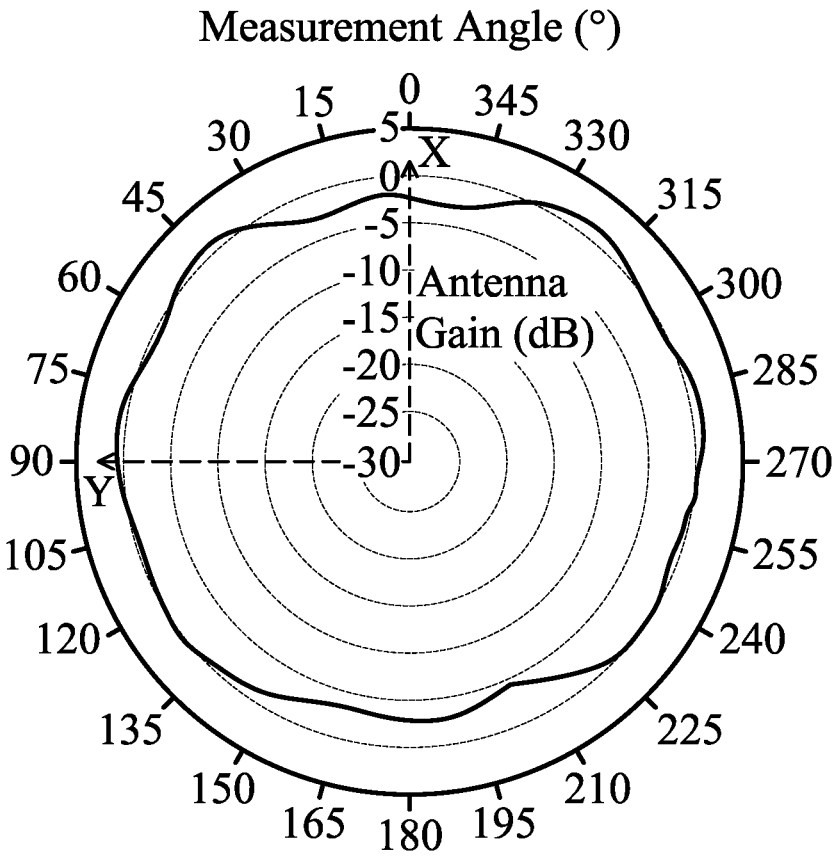
FIG. 4C is a diagram of antenna gain of an antenna structure measured on another plane according to an embodiment of the invention.

FIG. 4A is a diagram of antenna gain of the antenna structure 100 measured on the XZ plane according to an embodiment of the invention. FIG. 4B is a diagram of the antenna gain of the antenna structure 100 measured on the YZ plane according to an embodiment of the invention. FIG. 4C is a diagram of the antenna gain of the antenna structure 100 measured on the XY plane according to an embodiment of the invention. According to the measurements of FIG. 4A, FIG. 4B, and FIG. 4C, the antenna structure 100 almost has an omnidirectional radiation pattern within the aforementioned operation frequency band FB1, and the ripple of the radiation pattern is smaller than 6 dB.

In some embodiments, the operational principles of the antenna structure 100 are as follows. The antenna structure 100 is classified as a cavity resonance antenna. In the invention, the bent conductive layer 130 divides the cavity 140 between the first conductive layer 110 and the second conductive layer 120 into the first portion 141 and the second portion 142. According to the practical measurement, there are opposite electric fields distributed in the first portion 141 and the second portion 142 of the cavity 140, and they correspond to resonant points at two different frequencies. The operation bandwidth of the antenna structure 100 is significantly increased because of the coupling effect formed between these resonant points. Specifically, if the first conductive layer 110 or the second conductive layer 120 has a circular shape, such a design can improve the omnidirectional pattern of the antenna structure 100. If the first feeding point FP1 is positioned on the bisector plane 161 of the first angle θ1 of the bent conductive layer 130, such a design can make the electric fields more uniformly distributed in the first portion 141 and the second portion 142 of the cavity 140, so as to increase the bandwidth of the antenna structure 100. If the first coaxial cable 150 is adjacent and at least partially parallel to the second conductive layer 120, such a design can effectively prevent the first coaxial cable 150 from negatively affecting the radiation pattern of the antenna structure 100, so as to reduce the cost of a conventional choke element applied to the first coaxial cable 150. The above detailed designs are optional features of the invention, and they are omitted in other embodiments.

In some embodiments, the element sizes of the antenna structure 100 are as follows. The first angle θ1 of the bent conductive layer 130 may be from about 10 degrees to about 350 degrees. The radius R2 of the second circular shape of the second conductive layer 120 may be substantially equal to the radius R1 of the first circular shape of the first conductive layer 110. Both the radius R1 of the first circular shape and the radius R2 of the second circular shape may be from 3/20 to 7/20 wavelength (3λ/20 ~7λ/20) of the central frequency of the operation frequency band FB1 of the antenna structure 100. The distance D1 between the first conductive layer 110 and the second conductive layer 120 (i.e., the height of the bent conductive layer 130 on the Z-axis) may be substantially from 1/54 to 1/9 wavelength (λ/54~λ/9) of the central frequency of the operation frequency band FB1 of the antenna structure 100. The distance r1 between the first feeding point FP1 and the central point CP1 of the first conductive layer 110 may be substantially from ½ to 1 times the radius R1 of the first circular shape. The above ranges of element sizes are calculated and obtained according to many experiment results, and they can optimize the operation bandwidth and the impedance matching of the antenna structure 100.

Figure 5A:
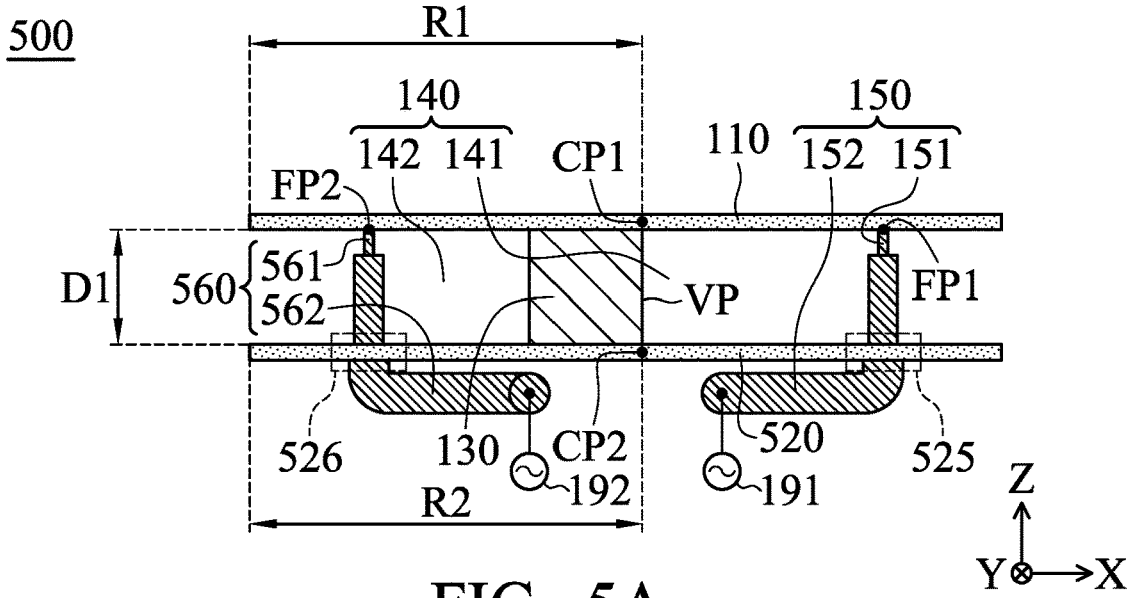
FIG. 5A is a side view of an antenna structure according to another embodiment of the invention.
Figure 5B:
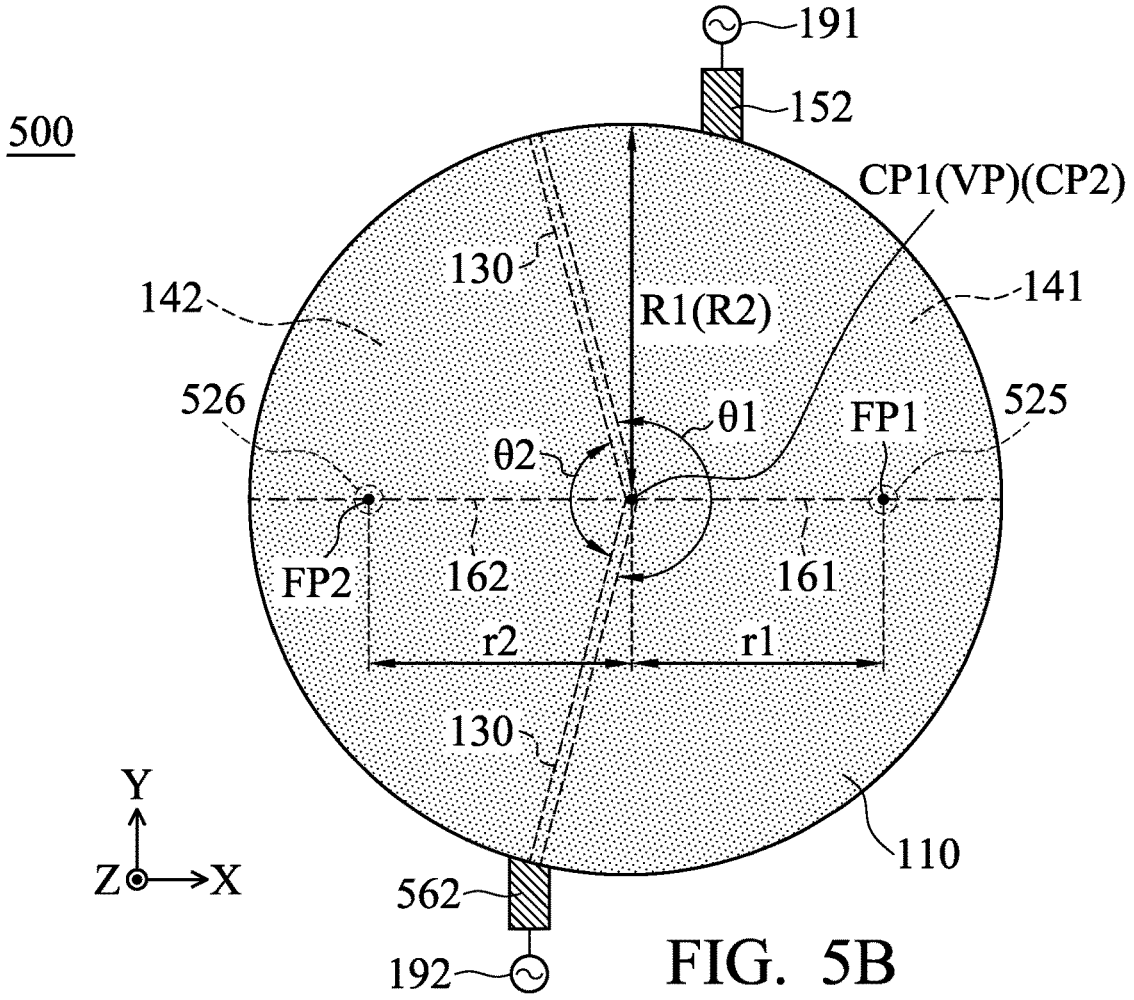
FIG. 5B is a top view of an antenna structure according to another embodiment of the invention.

FIG. 5A is a side view of an antenna structure 500 according to another embodiment of the invention. FIG. 5B is a top view of the antenna structure 500 according to another embodiment of the invention. Please refer to FIG. 5A and FIG. 5B together. In the embodiment of FIG. 5A and FIG. 5B, the antenna structure 500 includes the first coaxial cable 150 and a second coaxial cable 560, and a second conductive layer 520 of the antenna structure 500 includes a first opening 525 and a second opening 526. Each of the first opening 525 and the second opening 526 may have any shape and any size. For example, any of the first opening 525 and the second opening 526 may substantially have a circular shape, a triangular shape, or a quadrilateral shape, but it is not limited thereto. As mentioned above, the first coaxial cable 150 is coupled through the first opening 525 to the first feeding point FP1. Specifically, the second coaxial cable 560 includes a second central conductive line 561 and a second conductive shielding 562. The second central conductive line 561 extending through the second opening 526 is coupled to a second feeding point FP2 on the first conductive layer 110. The second conductive shielding 562 is coupled to the second conductive layer 520. A second signal source 192 is arranged for exciting the antenna structure 500. For example, the second signal source 192 may be another RF module. The positive electrode of the second signal source 192 may be coupled to the second central conductive line 561, and the negative electrode of the second signal source 192 may be coupled to the second conductive shielding 562. In some embodiments, the second coaxial cable 560 is adjacent to and at least partially parallel to the second conductive layer 520 (or the second coaxial cable 560 has at least one right-angle bending portion). Specifically, the first feeding point FP1 and the second feeding point FP2 are positioned at two different sides of the bent conductive layer 130, respectively. The first feeding point FP1 and the second feeding point FP2 are adjacent to the first portion 141 and the second portion 142 of the cavity 140, respectively. The bent conductive layer 130 has a first angle θ1 and a second angle θ2. The sum of the first angle θ1 and the second angle θ2 is equal to about 360 degrees. The first feeding point FP1 is substantially positioned on the bisector plane 161 of the first angle θ1. The second feeding point FP2 is substantially positioned on the bisector plane 162 of the second angle θ2. The distance r2 between the second feeding point FP2 and the central point CP1 of the first conductive layer 110 may be substantially from ½ to 1 times the radius R1 of the first circular shape of the first conductive layer 110. It should be noted that such a dual-feeding design can enhance the intensity of the electric fields in both the first portion 141 and the second portion 142 of the cavity 140, so as to allow the antenna structure 500 to operate in multiple frequency bands. Other features of the antenna structure 500 of FIG. 5A and FIG. 5B are similar to those of the antenna structure 100 of FIG. 1A and FIG. 1B. Accordingly, the two embodiments can achieve similar levels of performance.

Figure 6A:
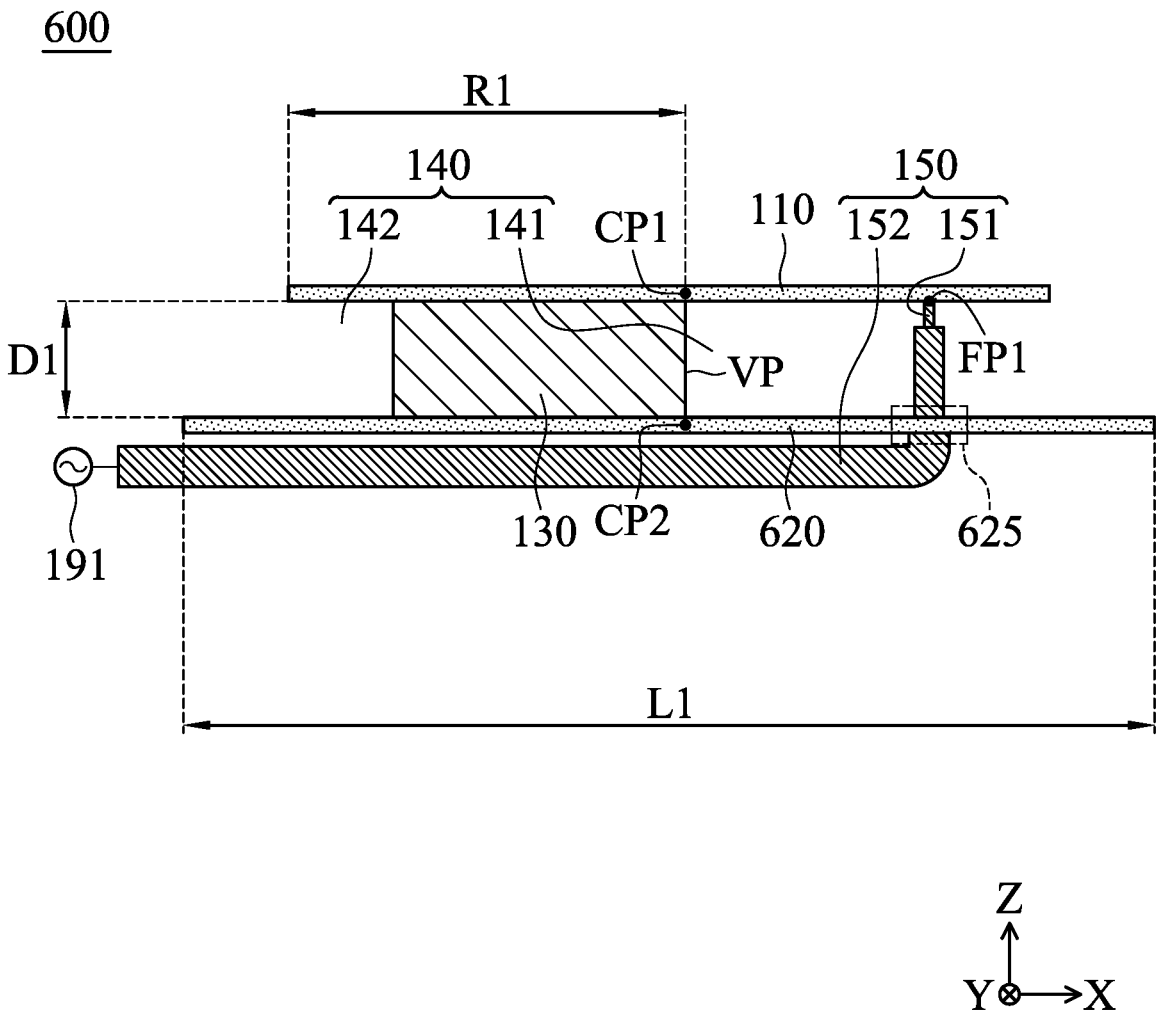
FIG. 6A is a side view of an antenna structure according to another embodiment of the invention.
Figure 6B:
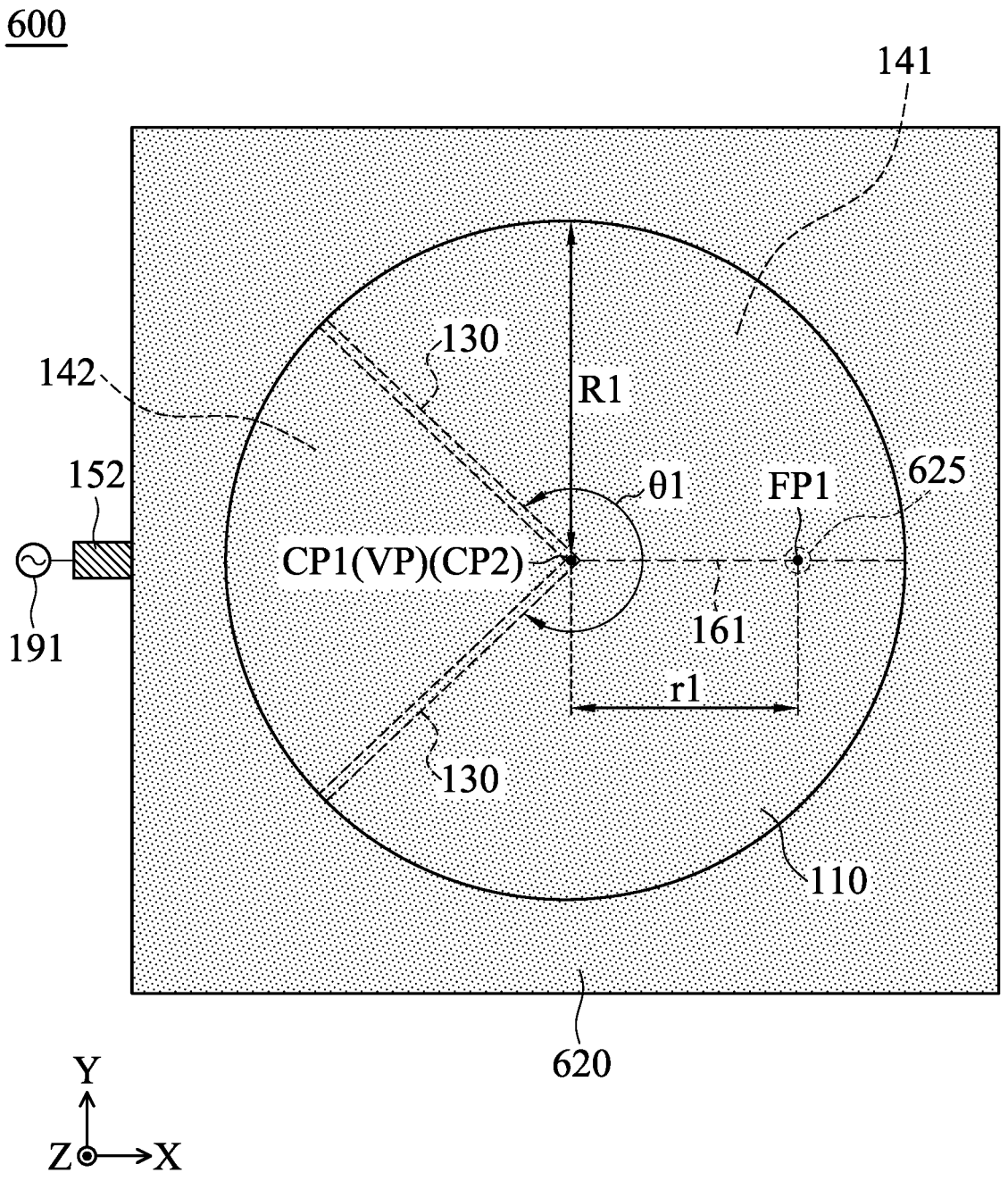
FIG. 6B is a top view of an antenna structure according to another embodiment of the invention.

FIG. 6A is a side view of an antenna structure 600 according to another embodiment of the invention. FIG. 6B is a top view of the antenna structure 600 according to another embodiment of the invention. Please refer to FIG. 6A and FIG. 6B together. In the embodiment of FIG. 6A and FIG. 6B, a second conductive layer 620 of the antenna structure 600 substantially has a square shape, and the area of the second conductive layer 620 is larger than or equal to the area of the first conductive layer 110. For example, the length L1 of each side of the square shape of the second conductive layer 620 may be at least 2 times the radius R1 of the first circular shape of the first conductive layer 110. The central point CP1 of the first conductive layer 110 (i.e., the center of the first circular shape), the central point CP2 of the second conductive layer 620 (i.e., the center of the square shape), and the bending line VP of the bent conductive layer 130 may be arranged in the same straight line. The aforementioned straight line is considered as a central axis of symmetry relative to the antenna structure 600. It should be noted that such a design including the second conductive layer 620 with a larger size can fine-tune the radiation pattern of the antenna structure 600, and therefore the antenna structure 600 provide directivity in response to different requirements. However, the invention is not limited thereto. In other embodiments, the second conductive layer 620 has any shape which is different from the first conductive layer 110, such as a rectangular shape, a regular triangle, a regular hexagon, a regular octagon, or an isosceles trapezoid. Other features of the antenna structure 600 of FIG. 6A and FIG. 6B are similar to those of the antenna structure 100 of FIG. 1A and FIG. 1B. Accordingly, the two embodiments can achieve similar levels of performance.

Figure 7A:
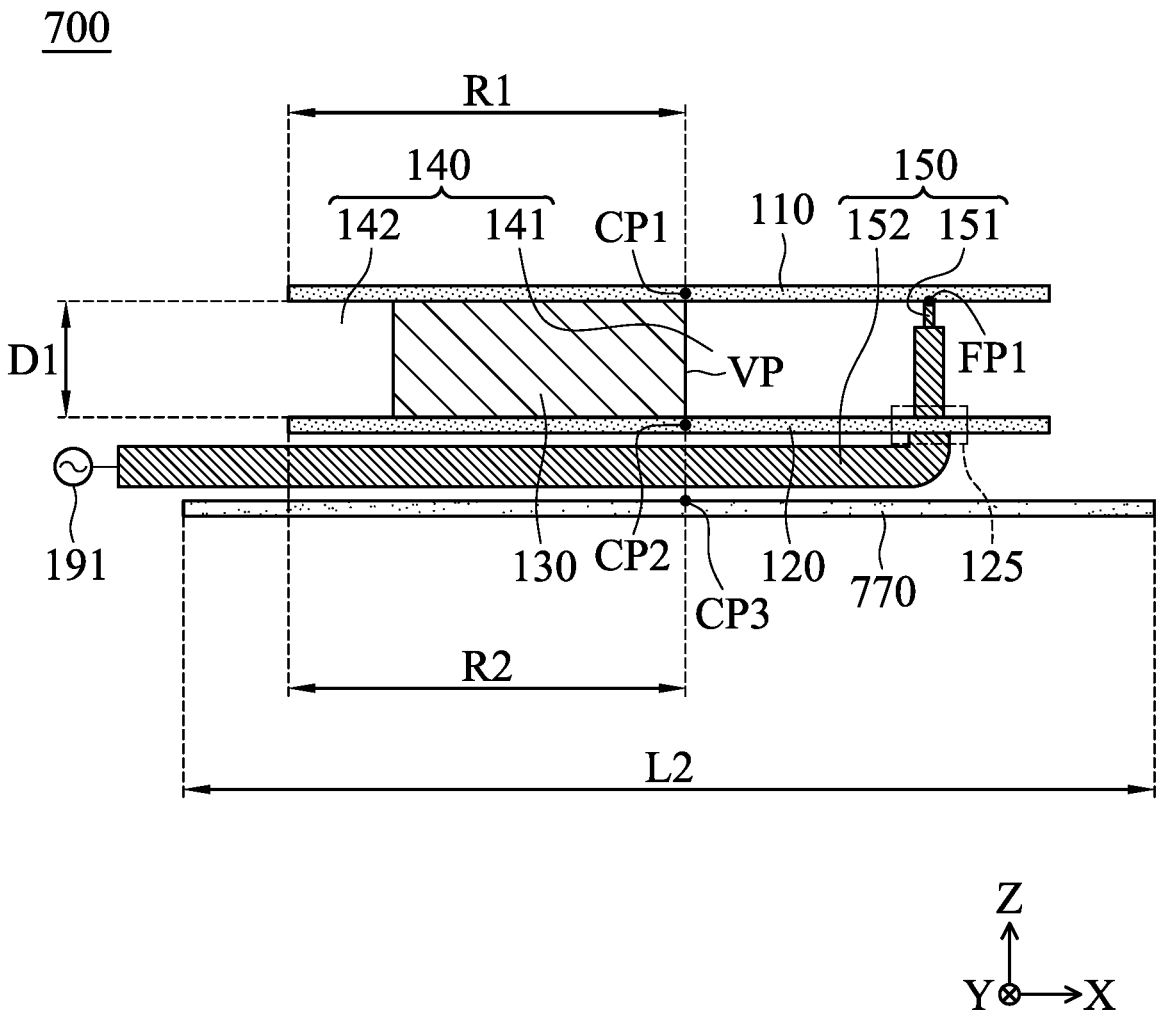
FIG. 7A is a side view of an antenna structure according to another embodiment of the invention.
Figure 7B:
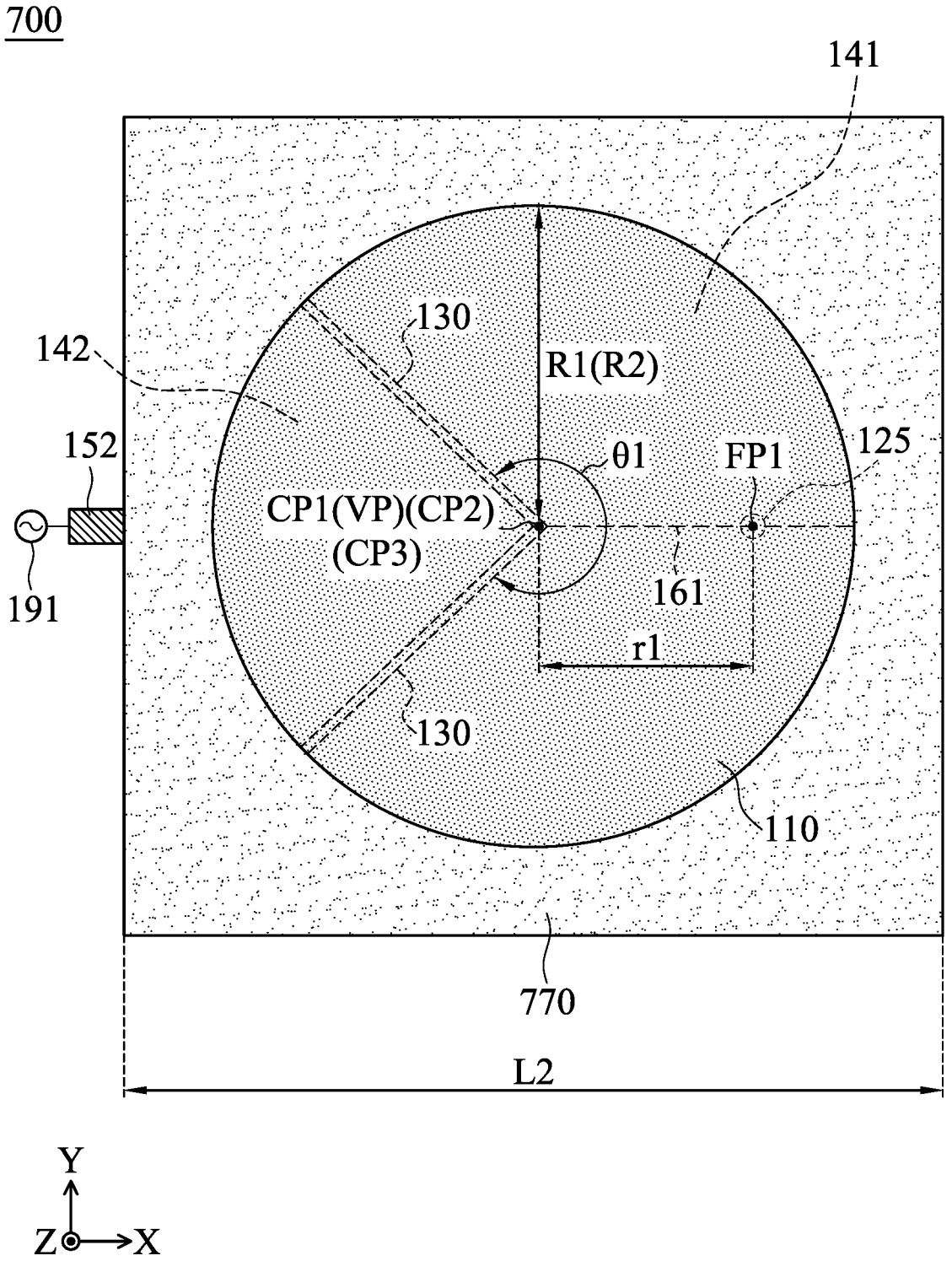
FIG. 7B is a top view of an antenna structure according to another embodiment of the invention.

FIG. 7A is a side view of an antenna structure 700 according to another embodiment of the invention. FIG. 7B is a top view of the antenna structure 700 according to another embodiment of the invention. Please refer to FIG. 7A and FIG. 7B together. In the embodiment of FIG. 7A and FIG. 7B, the antenna structure 700 further includes a reflective conductive layer 770. The reflective conductive layer 770 is disposed adjacent to the second conductive layer 120. The second conductive layer 120 is positioned between the first conductive layer 110 and the reflective conductive layer 770. The reflective conductive layer 770 may substantially have a square shape. The area of the reflective conductive layer 770 may be larger than or equal to the area of each of the first conductive layer 110 and the second conductive layer 120. For example, the length L2 of each side of the square shape of the reflective conductive layer 770 may be at least 2 times the radius R1 of the first circular shape of the first conductive layer 110, or may be at least 2 times the radius R2 of the second circular shape of the second conductive layer 120. The central point CP1 of the first conductive layer 110 (i.e., the center of the first circular shape), the central point CP2 of the second conductive layer 120 (i.e., the center of the second circular shape), the bending line VP of the bent conductive layer 130, and the central point CP3 of the reflective conductive layer 770 may be arranged in the same straight line. The aforementioned straight line is considered as a central axis of symmetry relative to the antenna structure 700. It should be noted that such a design including the reflective conductive layer 770 with a larger size can reflect the back-side electromagnetic waves of the antenna structure 700, so as to increase the antenna gain and the directivity of the antenna structure 700. However, the invention is not limited thereto. In other embodiments, the reflective conductive layer 770 has any shape, such as a circular shape, a rectangular shape, a regular triangle, a regular hexagon, a regular octagon, or an isosceles trapezoid. Other features of the antenna structure 700 of FIG. 7A and FIG. 7B are similar to those of the antenna structure 100 of FIG. 1A and FIG. 1B. Accordingly, the two embodiments can achieve similar levels of performance.

The invention proposes a communication device whose antenna system has the advantages of wide bandwidth and high radiation efficiency. The invention is suitable for application in a variety of indoor environments, so as to solve the problem of poor communication quality due to signal reflection and multipath fading in conventional designs.

Note that the above element sizes, element shapes, and frequency ranges are not limitations of the invention. An antenna designer can fine-tune these settings or values according to different requirements. It should be understood that the antenna structure of the invention is not limited to the configurations of FIGS. 1-7. The invention may merely include any one or more features of any one or more embodiments of FIGS. 1-7. In other words, not all of the features displayed in the figures should be implemented in the antenna structure of the invention.

Use of ordinal terms such as "first", "second", "third", etc., in the claims to modify a claim element does not by itself connote any priority, precedence, or order of one claim element over another or the temporal order in which acts of a method are performed, but are used merely as labels to distinguish one claim element having a certain name from another element having the same name (but for use of the ordinal term) to distinguish the claim elements.

While the invention has been described by way of example and in terms of the preferred embodiments, it should be understood that the invention is not limited to the disclosed embodiments. On the contrary, it is intended to cover various modifications and similar arrangements (as would be apparent to those skilled in the art). Therefore, the scope of the appended claims should be accorded the broadest interpretation so as to encompass all such modifications and similar arrangements.

What is claimed is:

1. An antenna structure, comprising:

a first conductive layer;

a second conductive layer, having a first opening, wherein a cavity is defined between the first conductive layer and the second conductive layer;

a bent conductive layer, coupled between the first conductive layer and the second conductive layer, wherein the bent conductive layer is configured to divide the cavity into a first portion and a second portion; and a first coaxial cable, comprising a first central conductive line and a first conductive shielding, wherein the first central conductive line is passed through the first opening and coupled to the first conductive layer as a first feeding point, and the first conductive shielding is coupled to the second conductive layer;

wherein the bent conductive layer has a first angle from 10 to 350 degrees.

2. The antenna structure as claimed in claim 1, wherein a bending line of the bent conductive layer is aligned with an extension line extending from a central point of the first conductive layer to a central point of the second conductive layer.

3. The antenna structure as claimed in claim 1, wherein the first coaxial cable is at least partially parallel to the second conductive layer.

4. The antenna structure as claimed in claim 1, wherein the first feeding point is positioned on a bisector plane of the first angle.

5. The antenna structure as claimed in claim 1, wherein the antenna structure covers an operation frequency band from 5150 MHz to 5850 MHz.

6. The antenna structure as claimed in claim 5, wherein a distance between the first conductive layer and the second conductive layer is from 1/54 to 1/9 wavelength of a central frequency of the operation frequency band.

7. The antenna structure as claimed in claim 5, wherein the first conductive layer substantially has a first circular shape.

8. The antenna structure as claimed in claim 7, wherein the second conductive layer substantially has a second circular shape.

9. The antenna structure as claimed in claim 8, wherein a radius of the second circular shape is equal to a radius of the first circular shape.

10. The antenna structure as claimed in claim 9, wherein a distance between the first feeding point and a central point of the first conductive layer is from 1/2 to 1 times the radius of the first circular shape.

11. The antenna structure as claimed in claim 9, wherein the radius of each of the first circular shape and the second circular shape is from 3/20 to 7/20 wavelength of a central frequency of the operation frequency band.

12. The antenna structure as claimed in claim 9, further comprising:

a reflective conductive layer, disposed adjacent to the second conductive layer, wherein the second conductive layer is positioned between the first conductive layer and the reflective conductive layer, the reflective conductive layer substantially has a square shape, and a length of each side of the square shape is at least 2 times the radius of the first circular shape.

13. The antenna structure as claimed in claim 9, wherein the second conductive layer further has a second opening, and the antenna structure further comprises:

a second coaxial cable, comprising a second central conductive line and a second conductive shielding, wherein the second central conductive line extending through the second opening is coupled to a second feeding point on the first conductive layer, and the second conductive shielding is coupled to the second conductive layer.

14. The antenna structure as claimed in claim 13, wherein the first feeding point and the second feeding point are positioned at two different sides of the bent conductive layer, respectively.

15. The antenna structure as claimed in claim 13, wherein the bent conductive layer further has a second angle, and the second feeding point is positioned on a bisector plane of the second angle.

16. The antenna structure as claimed in claim 15, wherein a sum of the first angle and the second angle is equal to 360 degrees.

17. The antenna structure as claimed in claim 13, wherein a distance between the second feeding point and a central point of the first conductive layer is from 1/2 to 1 times the radius of the first circular shape.

18. The antenna structure as claimed in claim 7, wherein the second conductive layer substantially has a square shape.

19. The antenna structure as claimed in claim 18, wherein a length of each side of the square shape is at least 2 times the radius of the first circular shape.

* * * * *